United States Patent [19]

Yim

[11] 4,375,045

[45] Feb. 22, 1983

[54] STARTING TRANSFORMER FOR GAS LAMPS WITH OPEN SECONDARY

[76] Inventor: Marvin G. Yim, 27305 Rainbow Ridge Rd., Palos Verdes Peninsula, Calif. 90274

[21] Appl. No.: 306,725

[22] Filed: Sep. 29, 1981

[51] Int. Cl.[3] ..... H05B 37/02

[52] U.S. Cl. ..... 315/209 R; 315/274; 315/276

[58] Field of Search ..... 315/209 R, 274, 275, 315/276, 330, 354

[56] References Cited

U.S. PATENT DOCUMENTS 3,693,044 9/1972 Gilman et al. ..... 315/274

*Primary Examiner*—Harold A. Dixon

[57] ABSTRACT

The specification discloses a starting transformer having a floating secondary. Coupling between the line and high voltage electrodes is effectuated through the distributed capacitance between the primary and secondary windings.

1 Claim, 3 Drawing Figures

STARTING TRANSFORMER FOR GAS LAMPS WITH OPEN SECONDARY

BACKGROUND OF THE INVENTION

1. Cross reference to related applications:

Reference is made to U.S. Pat. No. 4,117,377 entitled CIRCUITS FOR STARTING AND OPERATING IONIZED GAS LAMPS by Bruce D. Jimerson, Henry H. Nakasone, & Marvin G. Yim.

2. Field of the Invention

High voltage pulse transformers can be utilized to generate a striking voltage for starting ionized gas lamps. In a typical circuit, the transformer secondary is connected to a proximity electrode which is adjacent to the external surface of the lamp. Where the lamp is utilized in an ungrounded fixture, it is necessary to isolate the third electrode from both sides of the A-C line to prevent dangerous electrical shocks which would otherwise occur if the third electrode were inadvertantly contacted by persons unaware of the potential.

One solution to the problem is the utilization of a high voltage capacitor to couple the secondary to the third electrode. Such capacitors are however, costly and bulky. What is actually desired is a means for achieving electrical isolation which does not require additional parts.

Accordingly, a primary object of the invention is to provide a pulse transformer having an electrically isolated secondary.

A further object of the invention is to provide a transformer whereby the secondary voltage is produced through a combination of the electromagnetic and electrostatic coupling between the windings.

Other objects and advantages of the invention will be obvious from the detailed description of a preferred embodiment given hereinbelow.

SUMMARY OF THE INVENTION

A preferred embodiment of the invention comprises a transformer having a high voltage secondary and a low voltage primary. The transformer is wound on a bobbin, in reverse order with the high voltage secondary nearest the bobbin axle. The primary windings are then added to the outer circumference of the secondary winding in order to optimize the capacitive coupling between the windings.

DETAILED DESCRIPTION OF A PREFERRED EMBODIMENT

Figure 1:
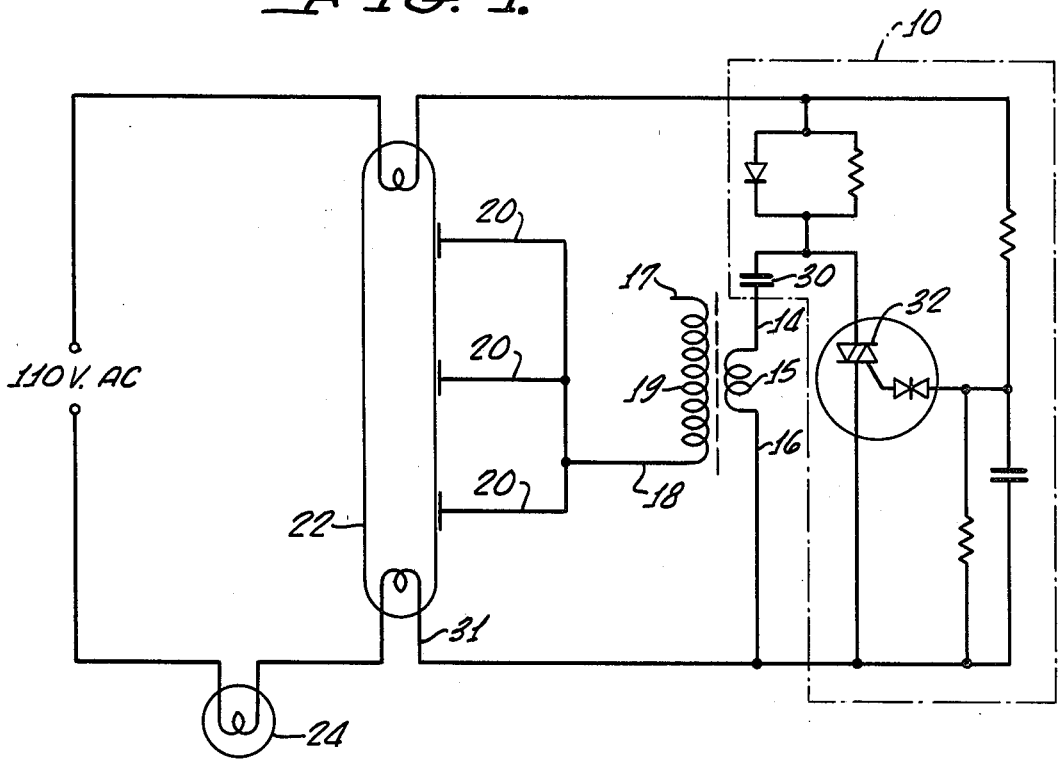
FIG. 1 shows a schematic diagram of the transformer and associated circuitry.

Adverting to the drawings, and particularly FIG. 1, the elements of the circuit comprise an ionized gas lamp 22 connected in series with a resistive ballast 24, a proximity electrode consisting of the three conductors 20 which are connected to the lead 18 of the high voltage secondary 19 of the starting transformer, and a starting circuit 10, the functional operation of which is fully described in the aforementioned U.S. Pat. No. 4,117,377. The primary leads 14 and 16 of the primary winding 15 are connected between capacitor 30 and filament lead 31, the charge on capacitor 30 being impressed across the primary winding 15 during each half cycle at the time triac 32 conducts. The abrupt transfer of charge from the capacitor 30 to the transformer primary 15 generates a high voltage spike across the transformer secondary 19. In the prior art configuration, one terminal (e.g. 17) of the transformer secondary 19 is connected to one side of the A-C line—either directly or through an impedance such as a resistor or capacitor. In the present invention, electrical isolation between the proximately electrode 20 and the A-C line is achieved by constructing the transformer so as to optimize the capacitance between the primary winding 15 and the secondary winding 19.

Figure 2:
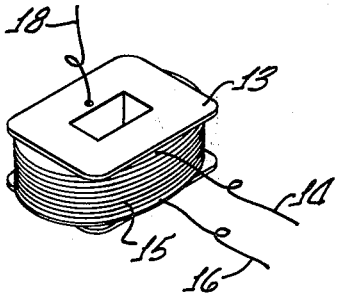
FIG. 2 shows a perspective view of the transformer.
Figure 3:
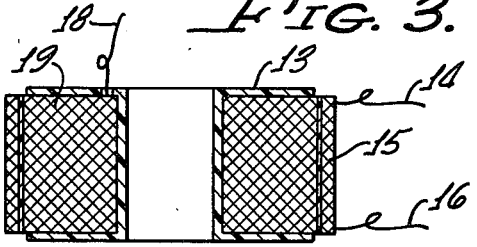
FIG. 3 shows a cross section of the transformer illustrating its construction.

Referring to FIGS. 2 and 3, the high capacitance between the primary and secondary windings is achieved by first winding the bobbin 13 with a high voltage secondary winding 19. The primary winding 15 is then wound on top of the secondary 19 so that a greater length of primary wire will be required for a given turns ratio. Since the capacitance between the primary and secondary windings will be approximately proportional to the length of the primary winding where $N_s >> N_p$, the desired goal is achieved.

Although the transformer is shown in combination with a particular starting circuit, it will be evident that the principal will be applicable to any type of ungrounded A-C circuit where electrical shock prevention is desirable or legally required for consumer use. Thus in table lamps and other two pronged plug-in lighting fixtures, there can be no certainty as to a ground reference, and the basic concept of the invention will be applicable to any conversion of these devices to fluoresent or other gas discharge lamp operation. Thus, although a preferred embodiment of the invention has been shown and described in a particular environment, it will be evident that teachings are not limited thereto, and that numerous changes, modifications, and substitutions may be made without departing from the spirit of the invention.

I claim:

1. A starting apparatus for an A-C line operated gas lamp comprising:

A transformer having a high voltage secondary and a low voltage primary winding placed about the outer circumference of said secondary winding;

a proximity electrode;

means for connecting one end of said secondary winding to said proximity electrode; and means for insulating the other end of said secondary winding from both sides of the A-C line.

* * * * *